US010781033B1

(12) United States Patent
Bulla et al.

(10) Patent No.: US 10,781,033 B1
(45) Date of Patent: Sep. 22, 2020

(54) REUSABLE BOTTLE PACKAGE

(71) Applicant: APC Packaging, LLC., Fort Lauderdale, FL (US)

(72) Inventors: Robert John Bulla, Coral Springs, FL (US); Curtis Luther Boggs, Pompano Beach, FL (US)

(73) Assignee: APC Packaging, LLC, Fort Lauderdale, FL (US)

( * ) Notice: Subject to any disclaimer, the term of this patent is extended or adjusted under 35 U.S.C. 154(b) by 0 days.

(21) Appl. No.: 16/822,425

(22) Filed: Mar. 18, 2020

Related U.S. Application Data

(60) Provisional application No. 62/927,259, filed on Oct. 29, 2019.

(51) Int. Cl.
*B65D 83/38* (2006.01)
*B65D 83/32* (2006.01)

(52) U.S. Cl.
CPC ..... *B65D 83/38* (2013.01); *B65D 83/32* (2013.01)

(58) Field of Classification Search
CPC .. B65D 83/38; B65D 83/32; B65D 2583/005; B65D 25/20; B65D 25/22; B05B 11/0054
USPC ..... 222/327; 220/480, 481
See application file for complete search history.

(56) References Cited

U.S. PATENT DOCUMENTS 3,985,299 A * 10/1976 Brenez ..... B05B 11/046 239/119
5,772,083 A * 6/1998 Joulia ..... B65D 83/205 222/325
6,053,363 A * 4/2000 Revenu ..... B05B 11/0038 222/82
6,196,419 B1 * 3/2001 Haney ..... B65D 83/202 222/153.03
8,800,818 B2 8/2014 Greenberg
8,950,634 B2 2/2015 Boes et al.
9,370,233 B2 * 6/2016 Jung ..... B05B 11/0054
10,071,850 B2 9/2018 Sugawara et al.
2007/0241134 A1 * 10/2007 Gurrisi ..... B65D 83/384 222/153.11
2008/0011778 A1 1/2008 Ronsin et al.
2009/0001103 A1 * 1/2009 Wanbaugh ..... B05B 11/0008 222/402.1
2015/0320948 A1 * 11/2015 Eicher ..... A61M 15/0073 128/200.21
2017/0275060 A1 9/2017 Hui et al.
2018/0290161 A1 10/2018 Lee
2018/0312328 A1 * 11/2018 Sugawara ..... B65D 83/38
2018/0339843 A1 * 11/2018 Cassoni ..... B29B 11/04
(Continued)

OTHER PUBLICATIONS

HTC Group—D05-1050, "https://hctgroup.com/products/d05-1050", downloaded on Jul. 1, 2020.

*Primary Examiner* — Benjamin R Shaw
(74) *Attorney, Agent, or Firm* — Fleit Intellectual Property Law; Jon Gibbons

(57) ABSTRACT

A reusable bottle package includes an inner bottle, an inner base coupled to the inner bottle, an outer bottle, an outer base coupled to the outer bottle, and a push-to-release button contained by the outer base. The outer base cooperates with the inner base to form at least one snap feature. The inner bottle is secured to the outer bottle when the at least one snap feature is engaged. The at least one snap feature becomes disengaged when the push-to-release button is depressed, thereby allowing the inner bottle to be removed from the outer bottle.

20 Claims, 21 Drawing Sheets

(56) References Cited

U.S. PATENT DOCUMENTS

| | | | | |
|---|---|---|---|---|
| 2018/0361413 | A1 | 12/2018 | Ruan | |
| 2020/0017272 | A1* | 1/2020 | Okude | B05B 11/0054 |
| 2020/0087053 | A1* | 3/2020 | Geier | B65D 83/62 |

* cited by examiner

REUSABLE BOTTLE PACKAGE

BACKGROUND

Field

This invention relates generally to bottles, and more specifically to a reusable bottle package for holding and delivering a cosmetic.

Related Art

Bottle packages for holding and delivering a cosmetic are well known. Bottle packages that include an inner container and an outer container are well known. Bottle packages that include a snap-fit joint, snap joint, or snap feature, are well known.

There are various types of snap features.

FIG. 1 is a simplified drawing of a known cantilever snap joint 100 which typically has a round snap bead and a sharp undercut.

FIG. 2 is a simplified drawing of a known annular snap joint 200.

FIG. 3 is a simplified drawing of a known U-shaped snap joint 300.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

The reusable bottle package 400 includes a mechanism for securing an inner bottle assembly to an outer bottle assembly and includes a release mechanism. The release mechanism includes a push-to-release button 434. The reusable bottle package 400 is, in one application, used in the cosmetic industry in order to increase functionality and sustainability of existing products. The reusable bottle package 400 allows an airless container product to be reusable with a removable, recyclable and replaceable inner bottle assembly by securement to the outer bottle assembly via snap feature(s) and by release from the outer bottle assembly via actuation of the push-to-release button 434.

Figure 1:
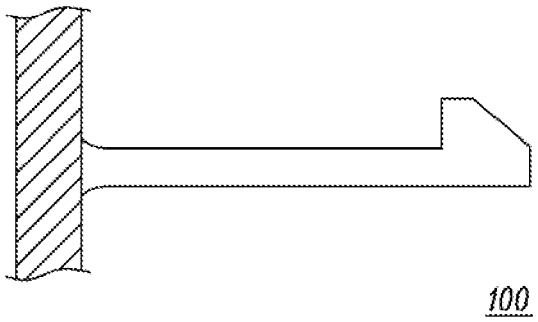
PRIOR ART FIG. 1
FIG. 1 is a simplified drawing of a known cantilever snap joint.
Figure 2:
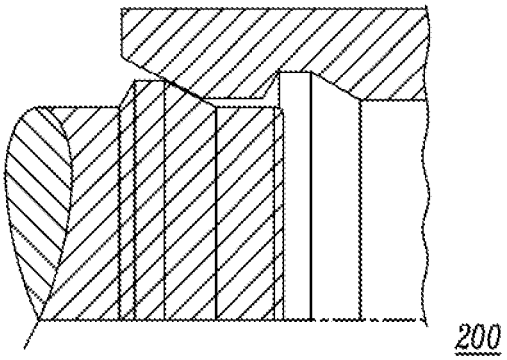
PRIOR ART FIG. 2
FIG. 2 is a simplified drawing of a known annular snap joint.
Figure 3:
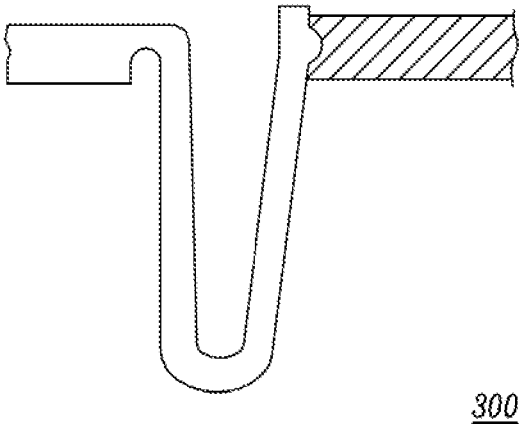
PRIOR ART FIG. 3
FIG. 3 is a simplified drawing of a known U-shaped snap joint.
Figure 4:
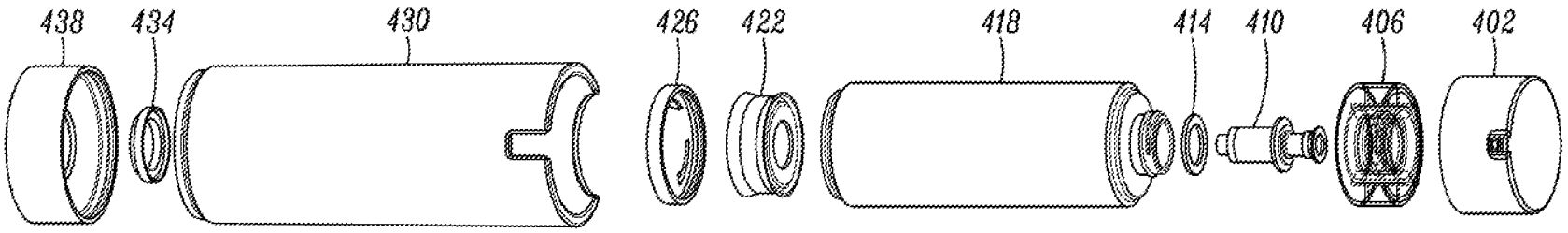
FIG. 4 is an exploded view of a reusable bottle package in accordance with a first embodiment of the invention, including an inner base, an inner bottle, an outer base, an outer bottle, and a push-to-release button.

As shown in FIG. 4, a reusable bottle package 400 in accordance with embodiments of the invention includes an actuator 402, a threaded inner collar 406, a pump engine 410, a gasket 414, an inner bottle 418, a piston 422, an inner base 426, an outer bottle 430, a push-to-release button 434 and an outer base 438. The actuator 402 includes a nozzle (not shown). The inner bottle 418 includes a piston (not shown). The outer base 438 includes stubs for holding the push-to-release button 434. The outer bottle 430 cooperates with the inner base 426 to form at least one snap feature. The inner bottle 418 is secured to the outer bottle 430 via the at least one snap feature.

The outer bottle 430 may include alignment features to ensure the proper assembly of the inner bottle 418. The inner base 426 includes a circular protrusion that is sized to cooperate with a circular opening in the outer base 438. The outer bottle 430 includes a plurality of ribs (not shown) that act as centering/alignment guides for the inner bottle 418 to slide into a center of the outer bottle 430. The push-to-release button (hereinafter "button") 434 releases an inner assembly from an outer assembly. The inner assembly consists of the inner base 426, the piston 422, the inner bottle 418, the gasket 414, the pump engine 410 and the inner collar 406. The outer assembly consists of the outer bottle 430, the button 434 and the outer base 438.

Figure 5:
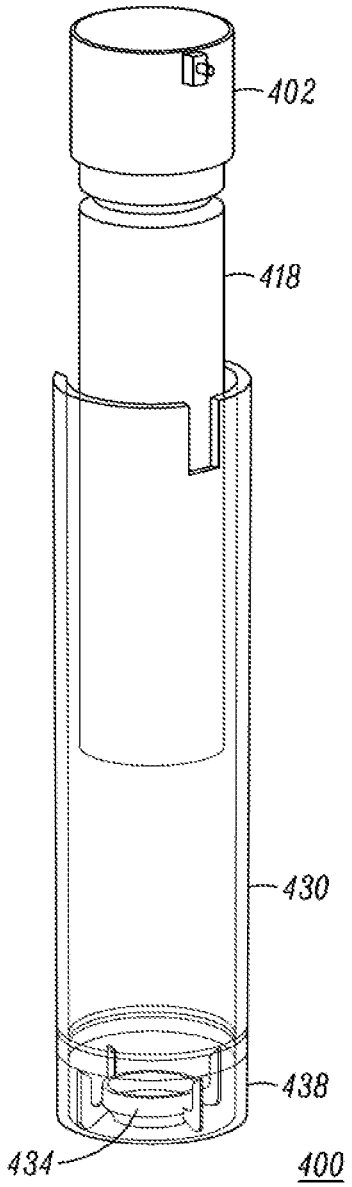
FIG. 5 is a perspective view of the reusable bottle package.

FIG. 5 is a perspective view of the reusable bottle package 400.

In a first embodiment, shown in FIGS. 6-28, the button is a flexible, or pliable, button. The pliable button 434 comprises one of a thermoplastic elastomer material, a thermoplastic polyurethane material, a silicone material, a thermoplastic rubber material, a thermoplastic urethane material, or another type of thermoset material. Release of the inner bottle 418 from the outer bottle 430 is accomplished by direct force applied to a center of the pliable button 434, which disengages the at least one snap feature to release the inner bottle assembly from the outer bottle assembly. In the first embodiment, the snap feature is an annular snap joint.

Figure 6:
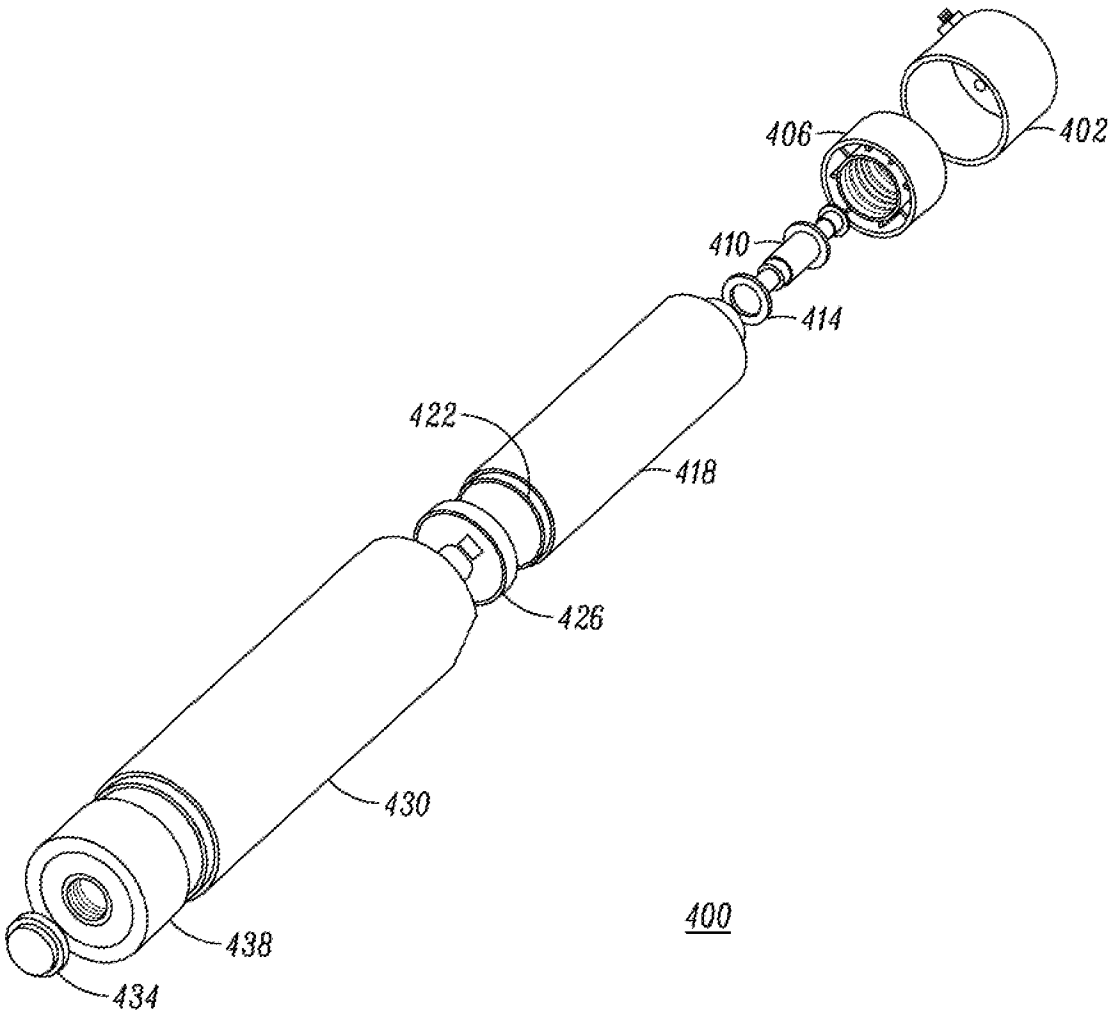
FIG. 6 is another exploded view of the reusable bottle package, including a pliable push-to-release button.

FIG. 6 is another exploded view of the reusable bottle package 400, including a pliable button 434.

Figure 7:
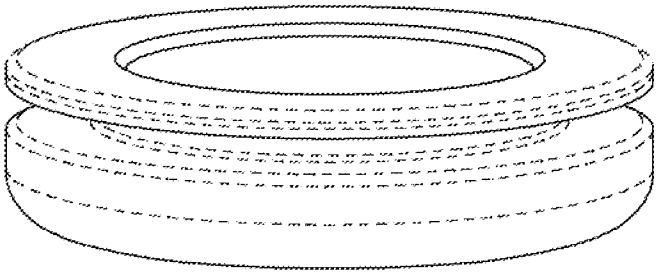
FIG. 7 is a perspective view of a pliable button in accordance with one embodiment of the invention.

FIG. 7 is a perspective view of the pliable button 434.

Figure 9:
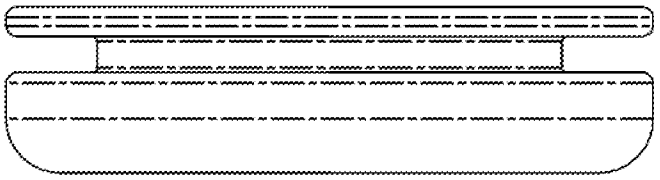
FIG. 9 is a side view of the pliable push-to-release button.

FIG. 9 is a side view of the pliable button 434.

Figure 8:
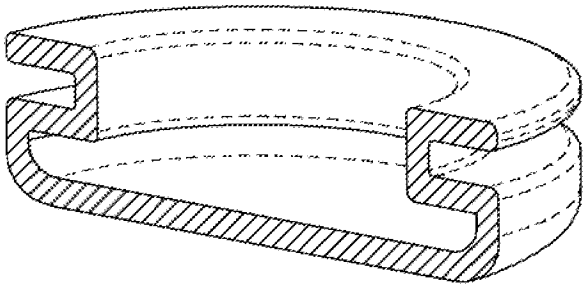
FIG. 8 is a cut-away perspective view of the pliable push-to-release button.

FIG. 8 is a cut-away perspective view of the pliable button 434.

Figure 10:
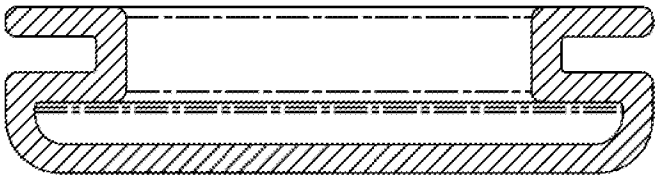
FIG. 10 is a cut-away side view of the pliable push-to-release button.

FIG. 10 is a cut-away side view of the pliable button 434.

Figure 11:
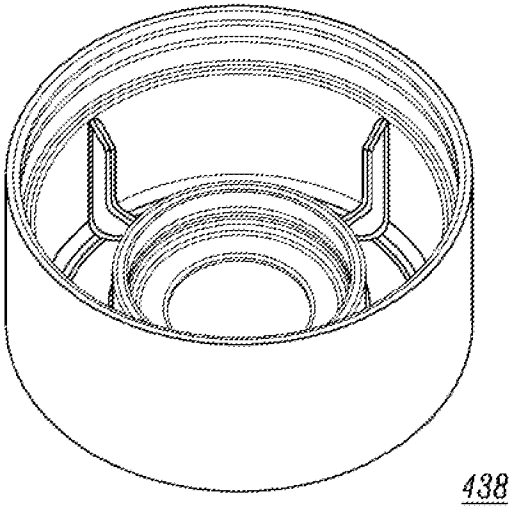
FIG. 11 is a perspective view of the outer base.

FIG. 11 is a perspective view of the outer base 438.

Figure 12:
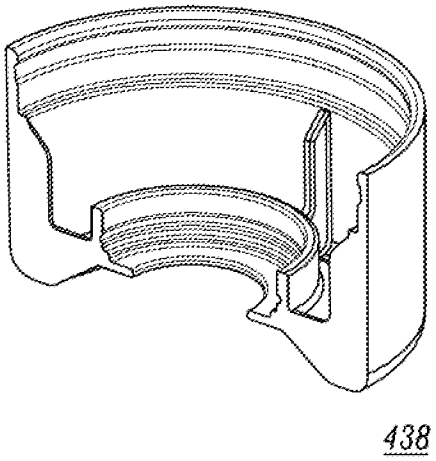
FIG. 12 is a cut-away perspective view of the outer base.

FIG. 12 is a cut-away perspective view of the outer base 438.

Figure 13:
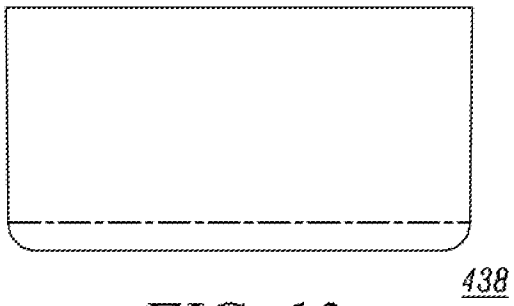
FIG. 13 is a side view of the outer base.

FIG. 13 is a side view of the outer base 438.

Figure 14:
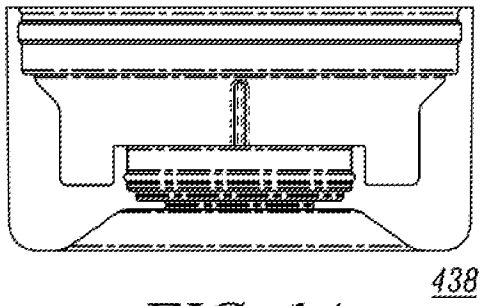
FIG. 14 is a cut-away side view of the outer base.

FIG. 14 is a cut-away side view of the outer base 438.

Figure 15:
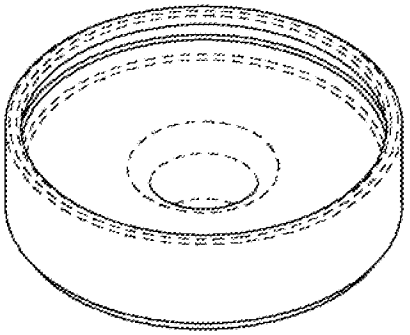
FIG. 15 is a perspective top view of the inner base.

FIG. 15 is a perspective top view of the inner base 422.

Figure 16:
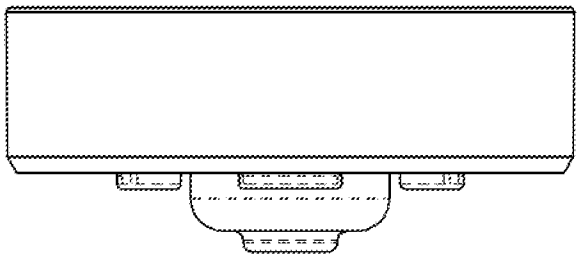
FIG. 16 is a side view of the inner base.

FIG. 16 is a side view of the inner base 422.

Figure 17:
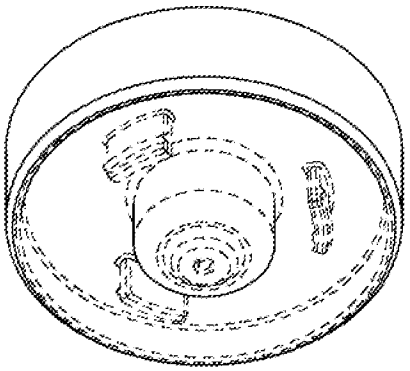
FIG. 17 is a perspective bottom view of the inner base.

FIG. 17 is a perspective bottom view of the inner base 422.

Figure 18:
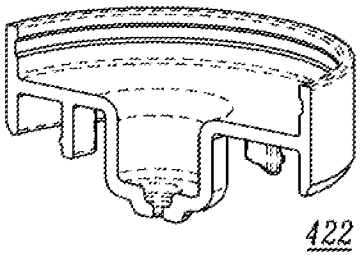
FIG. 18 is a cut-away perspective top view of the inner base.

FIG. 18 is a cut-away perspective top view of the inner base 422.

Figure 19:
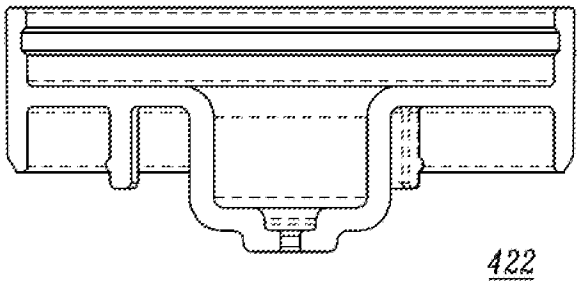
FIG. 19 is a cut-away side view of the inner base.

FIG. 19 is a cut-away side view of the inner base 422.

Figure 20:
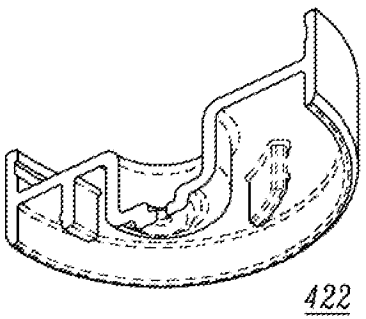
FIG. 20 is a cut-away perspective bottom view of the inner base.

FIG. 20 is a cut-away perspective bottom view of the inner base 422.

Figure 21:
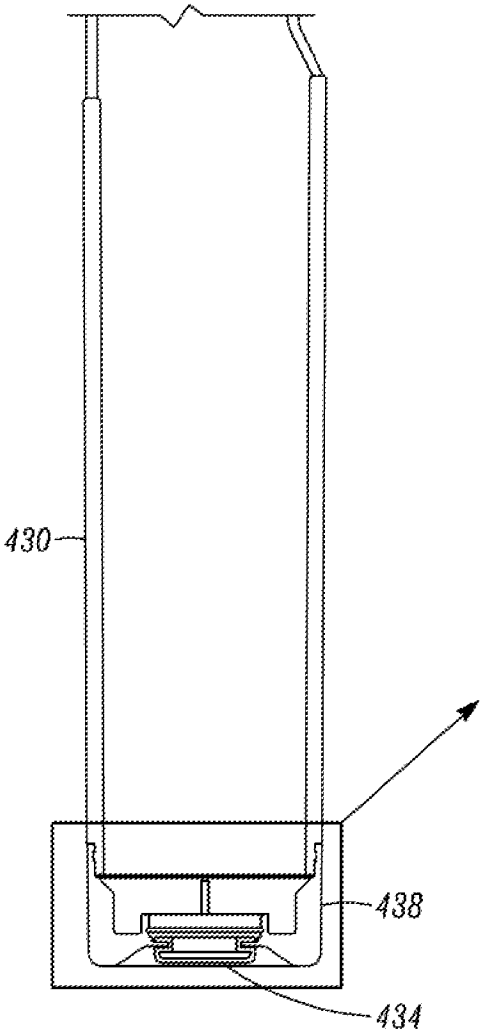
FIG. 21 is a cut-way side view of the outer bottle, the outer base and the pliable push-to-release button in a static state.

FIG. 21 is a cut-way side view of the outer bottle 430, the outer base 438 and the pliable button 434 in a static state.

Figure 22:
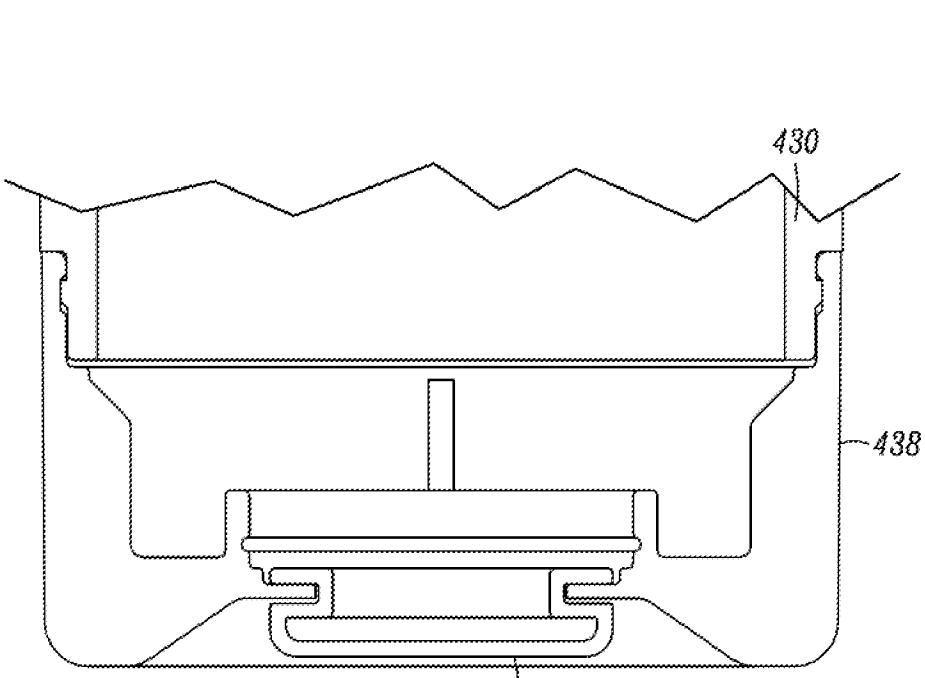
FIG. 22 is an enlarged view of a portion of FIG. 21.

FIG. 22 is an enlarged view of a portion of FIG. 21.

Figure 23:
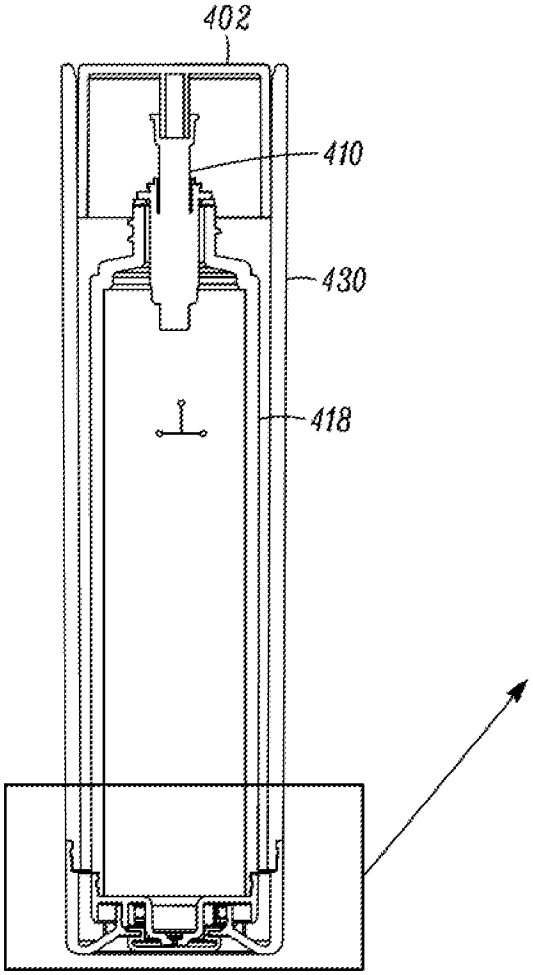
FIG. 23 is a cut-way side view of the inner bottle, inner base, outer bottle, the outer base and the pliable push-to-release button in the static state.

FIG. 23 is a cut-way side view of the actuator 402, the inner bottle 418, inner base 426, outer bottle 430, the outer base 438 and the pliable button 434 in the static state.

Figure 24:
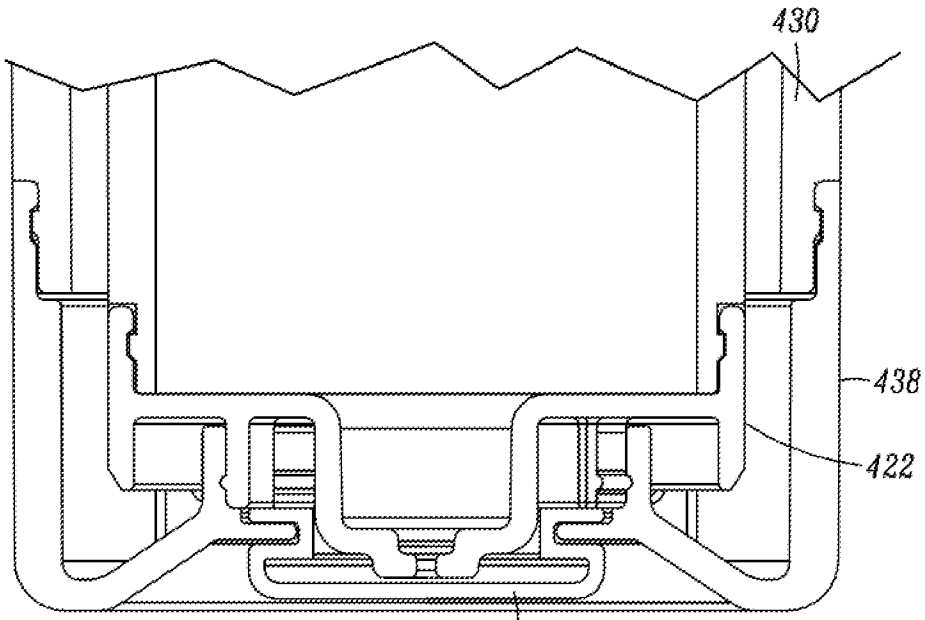
FIG. 24 is an enlarged view of a portion of FIG. 23.

FIG. 24 is an enlarged view of a portion of FIG. 23 showing details of the piston 422.

Figure 25:
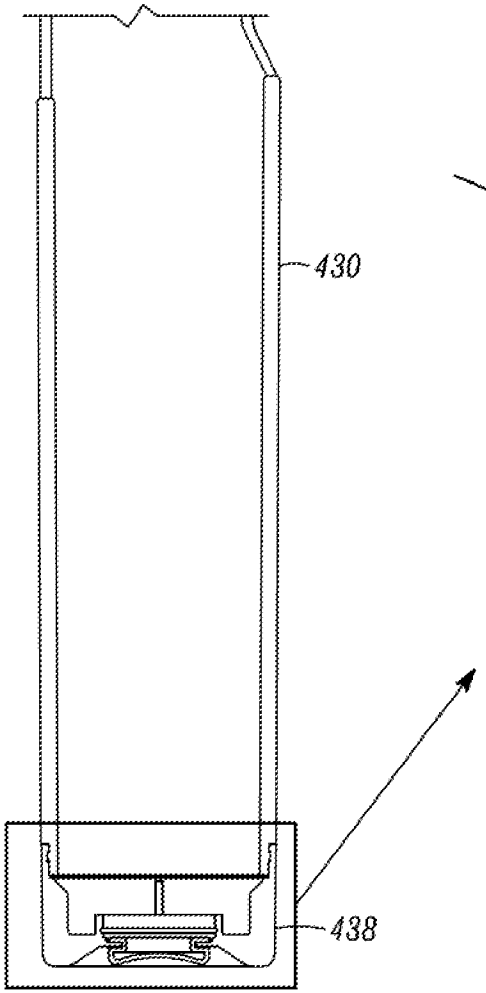
FIG. 25 is a cut-way side view of the actuator, the outer bottle, the outer base and the pliable push-to-release button in a depressed state.

FIG. 25 is a cut-way side view of the outer bottle 430, the outer base 438 and the pliable button 434 in a depressed state.

Figure 26:
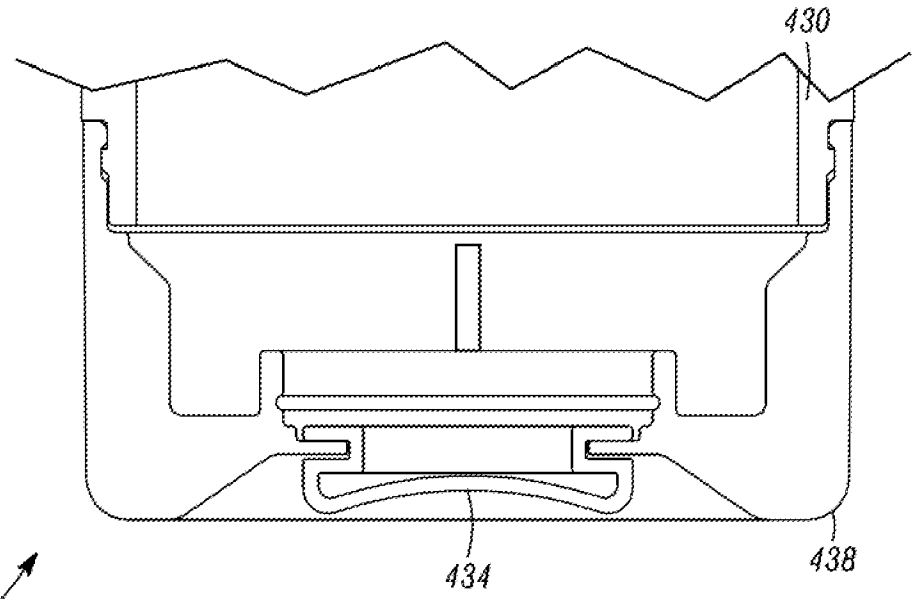
FIG. 26 is an enlarged view of a portion of FIG. 25.

FIG. 26 is an enlarged view of a portion of FIG. 25.

Figure 27:
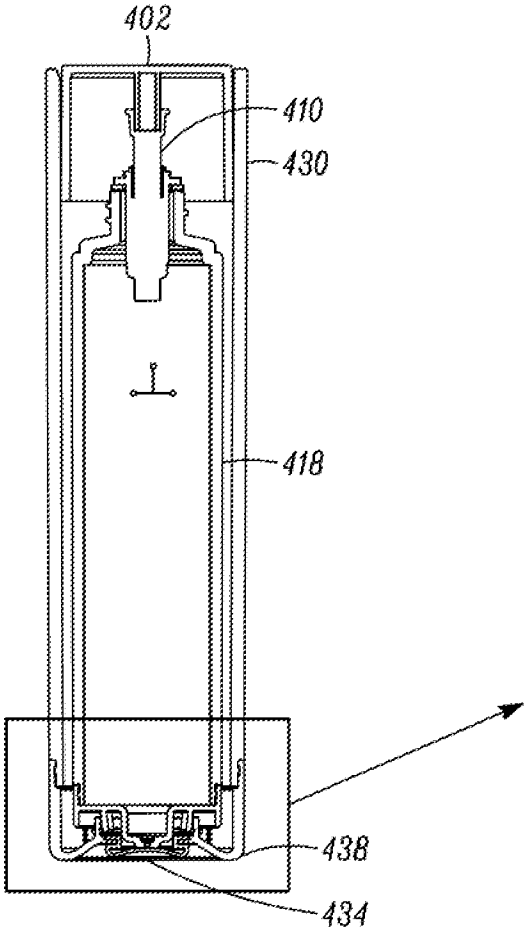
FIG. 27 is a cut-way side view of the actuator, the inner bottle, inner base, outer bottle, the outer base and the pliable push-to-release button in the depressed state.

FIG. 27 is a cut-way side view of the actuator 402, the inner bottle 418, inner base 422, outer bottle 430, the outer base 438 and the pliable button 434 in the depressed state.

Figure 28:
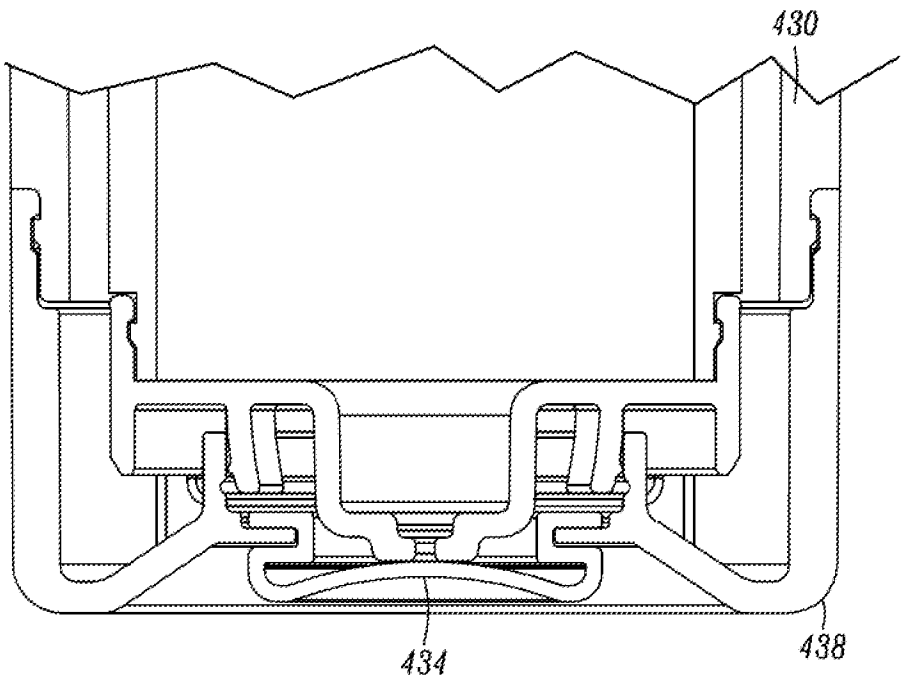
FIG. 28 is an enlarged view of a portion of FIG. 27.

FIG. 28 is an enlarged view of a portion of FIG. 27.

In a second embodiment of the reusable bottle package 2900, shown in FIGS. 29-47, the button is a rigid button 2934. The rigid button 2934 comprises any thermoplastic material that that meets physical specifications required for actuating the release mechanism of the inner assembly from the outer assembly. In one embodiment, the rigid button 2934 comprises one of a polypropylene material, an acrylonitrile butadiene styrene material, a nylon material, a filled material, a plastic, a moldable polymer, a resin and a glass.

Figure 29:
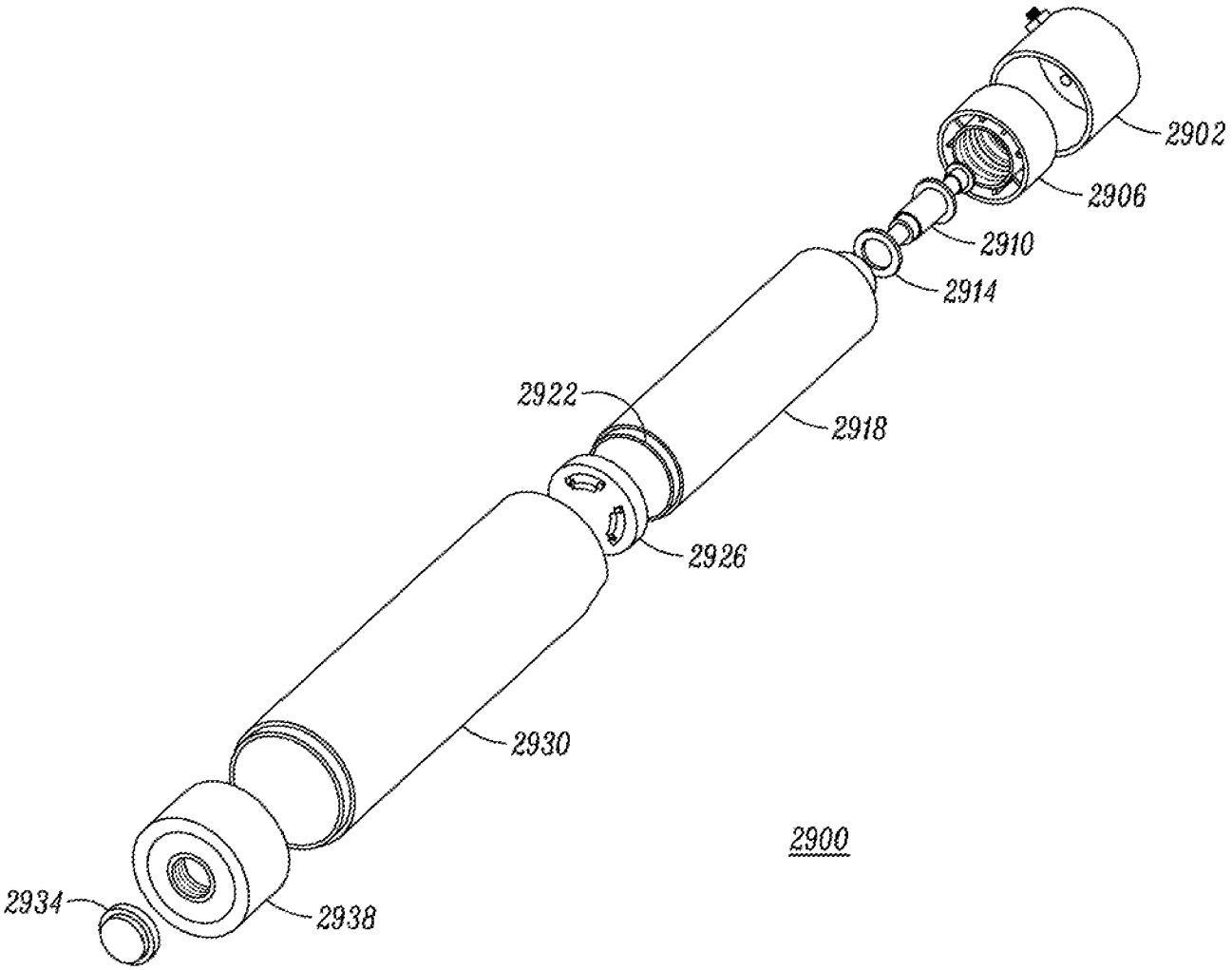
FIG. 29 is an exploded view of the reusable bottle package in accordance with a second embodiment of the invention, including an outer bottle, an outer base, an inner bottle, an inner base, a pump engine, an inner collar, an actuator and a rigid push-to-release button.

FIG. 29 is an exploded view of the reusable bottle package 2900 in accordance with a second embodiment of the invention, The reusable bottle package 2900 comprises an actuator 2902, an inner collar 2906, a pump engine 2910, a gasket 2914, an inner bottle 2918, an inner base 2926, a piston 2922, an outer bottle 2930, an outer base 2938, and the rigid button 2934.

Figure 30:
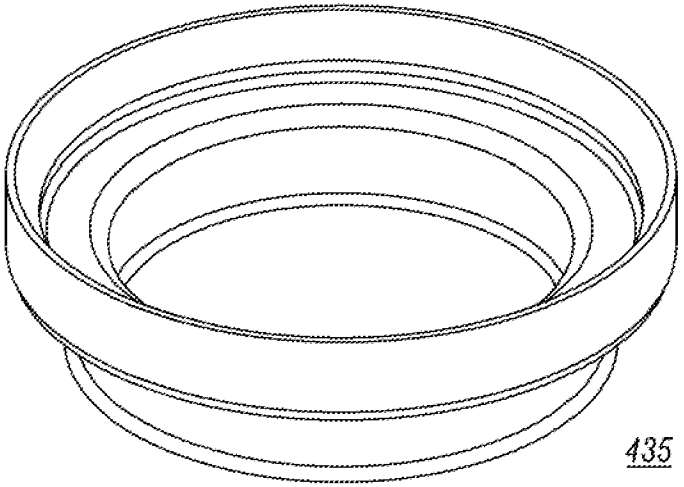
FIG. 30 is a perspective view of the rigid push-to-release button.

FIG. 30 is a perspective view of the rigid button 2934.

Figure 31:
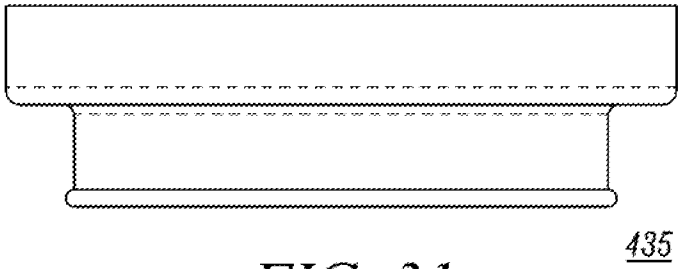
FIG. 31 is a side view of the rigid push-to-release button.

FIG. 31 is a side view of the rigid button 2934.

Figure 32:
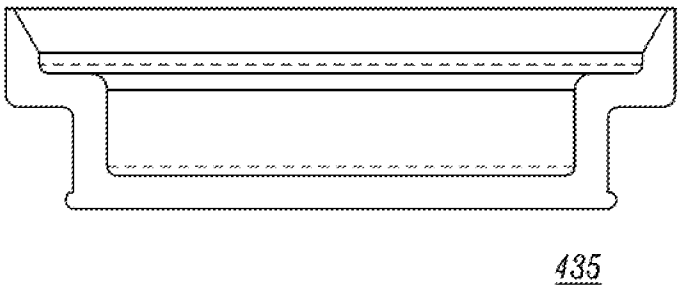
FIG. 32 is a cut-away side view of the rigid push-to-release button.

FIG. 32 is a cut-away side view of the rigid button 2934.

Figure 33:
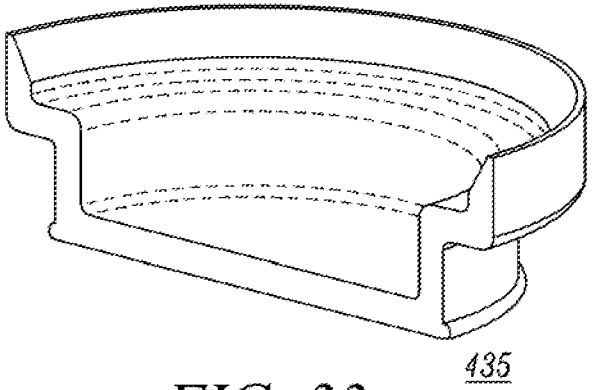
FIG. 33 is a cut-away side perspective view of the rigid push-to-release button.

FIG. 33 is a cut-away side perspective view of the rigid button 2934.

Figure 34:
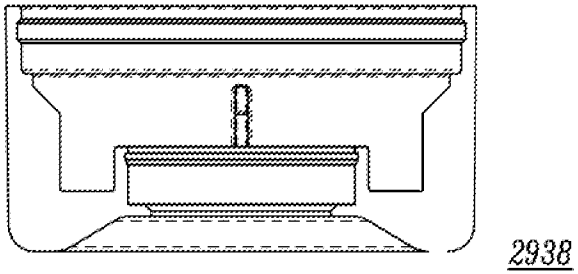
FIG. 34 is a cut-away side view of the outer base.

FIG. 34 is a cut-away side view of the outer base 2938.

Figure 35:
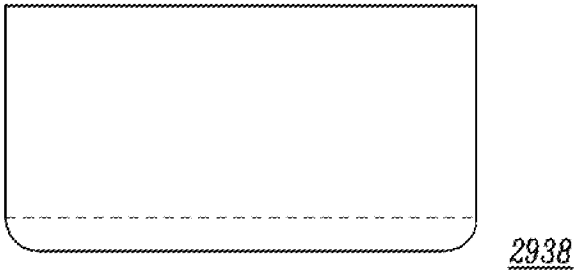
FIG. 35 is a side view of the outer base.

FIG. 35 is a side view of the outer base 2938.

Figure 36:
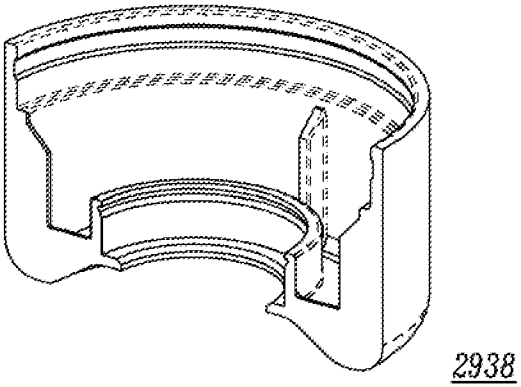
FIG. 36 is a cut-away perspective view of the outer base.

FIG. 36 is a cut-away perspective view of the outer base 2938.

Figure 37:
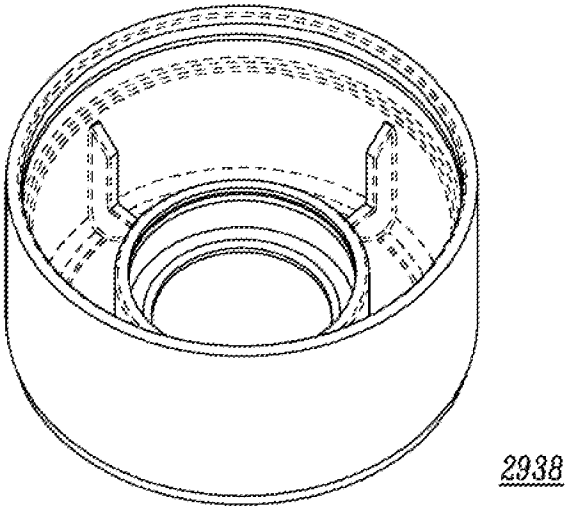
FIG. 37 is a perspective top view of the outer base.

FIG. 37 is a perspective top view of the outer base 2938.

Figure 38:
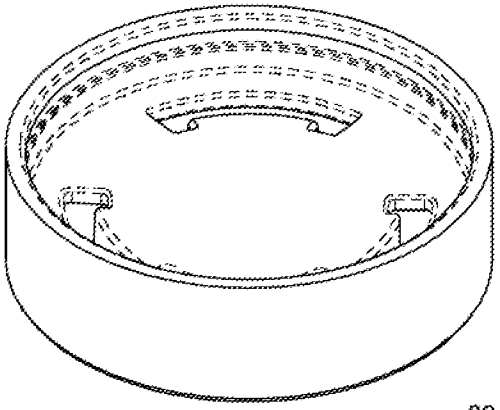
FIG. 38 is a perspective top view of an inner base in accordance with the second embodiment of the invention.

FIG. 38 is a perspective top view of the inner base 2926.

Figure 39:
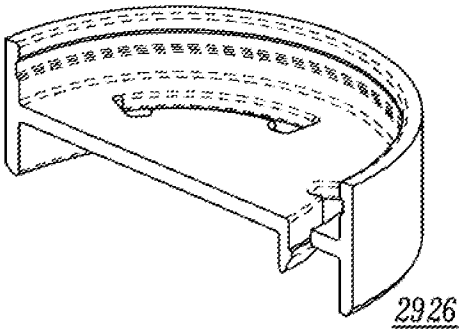
FIG. 39 is a cut-away perspective top view of the inner base.

FIG. 39 is a cut-away perspective top view of the inner base 2926.

Figure 40:
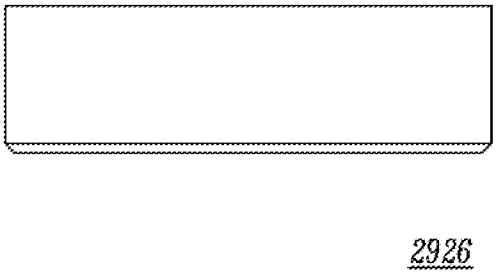
FIG. 40 is a side view of the inner base.

FIG. 40 is a side view of the inner base 2926.

Figure 41:
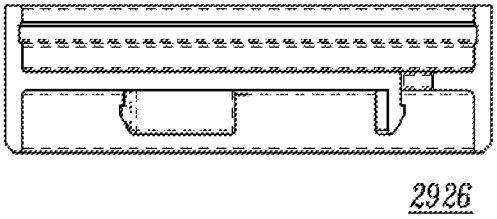
FIG. 41 is a cut-away side view of the inner base.

FIG. 41 is a cut-away side view of the inner base 2926.

Figure 42:
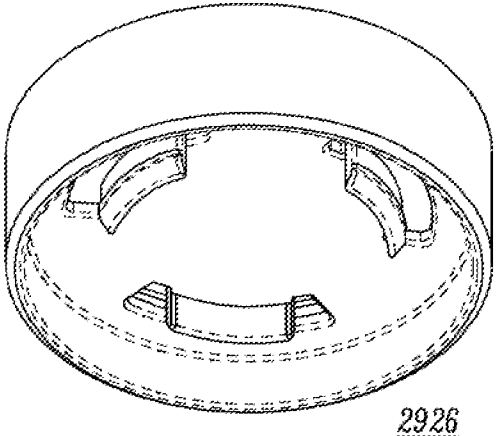
FIG. 42 is a perspective bottom view of the inner base.

FIG. 42 is a perspective bottom view of the inner base 2926.

Figure 43:
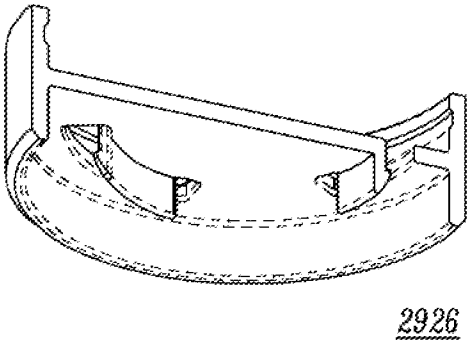
FIG. 43 is a cut-away perspective bottom view of the inner base.

FIG. 43 is a cut-away perspective bottom view of the inner base 2926.

Figure 44:
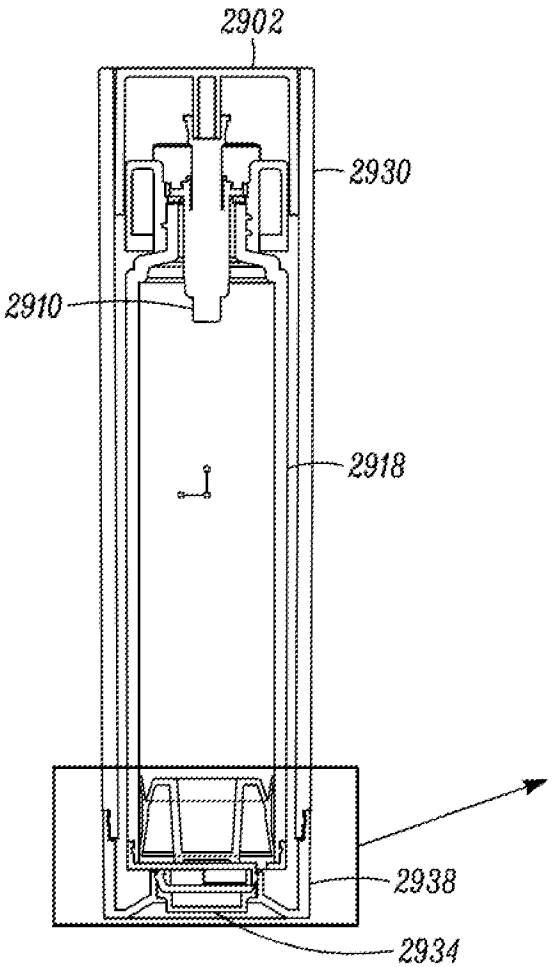
FIG. 44 is a cut-away side view of the outer bottle, outer base, inner bottle, inner base, pump engine, inner collar, actuator and rigid button in a static state, in accordance with the second embodiment, showing a snap feature engaged.

FIG. 44 is a cut-away side view of the outer bottle 2930, the outer base 2938, the inner bottle 2918, the piston 2922, the inner base 2926, the pump engine 2910, the gasket 2914, the inner collar 2906, the actuator 2902 and the rigid button 2934 in a static state, in accordance with the second embodiment, and showing the snap feature engaged.

Figure 45:
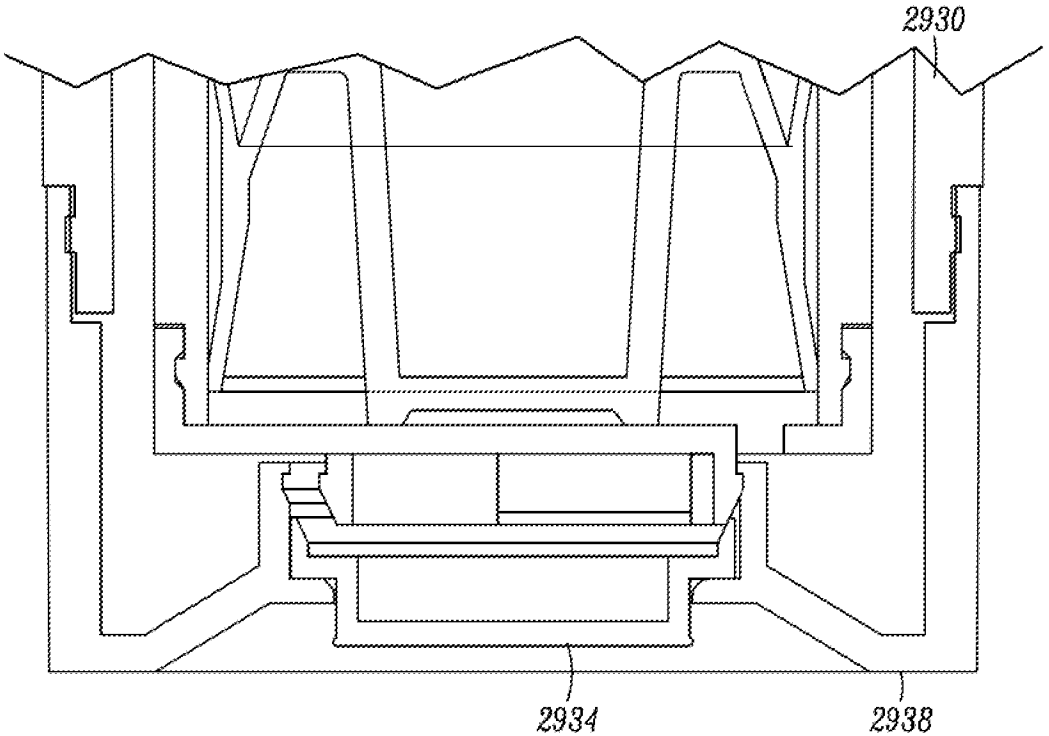
FIG. 45 is an enlargement of a portion of FIG. 44.

FIG. 45 is an enlargement of a portion of FIG. 44.

Figure 46:
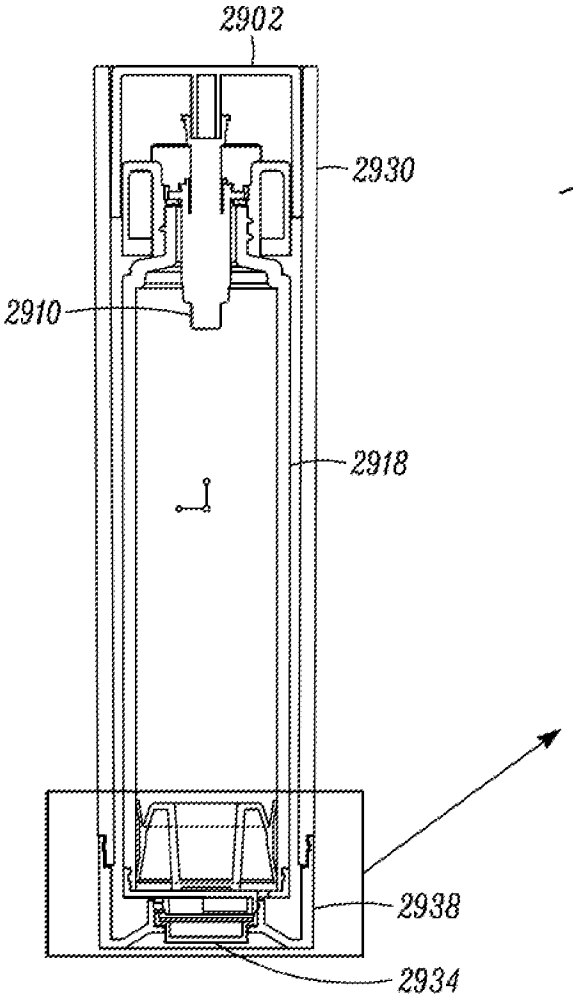
FIG. 46 is a cut-away side view of the outer bottle, outer base, inner bottle, inner base, pump engine, inner collar, actuator and rigid button in a depressed state, in accordance with the second embodiment, showing the snap feature disengaged.

FIG. 46 is a cut-away side view of the outer bottle 2930, the outer base 2938, the inner bottle 2918, the piston 2922, the inner base 2926, the pump engine 2910, the gasket 2914, the inner collar 2906, the actuator 2902 and the rigid button 2934 in a depressed state, in accordance with the second embodiment, and showing the snap feature disengaged.

Figure 47:
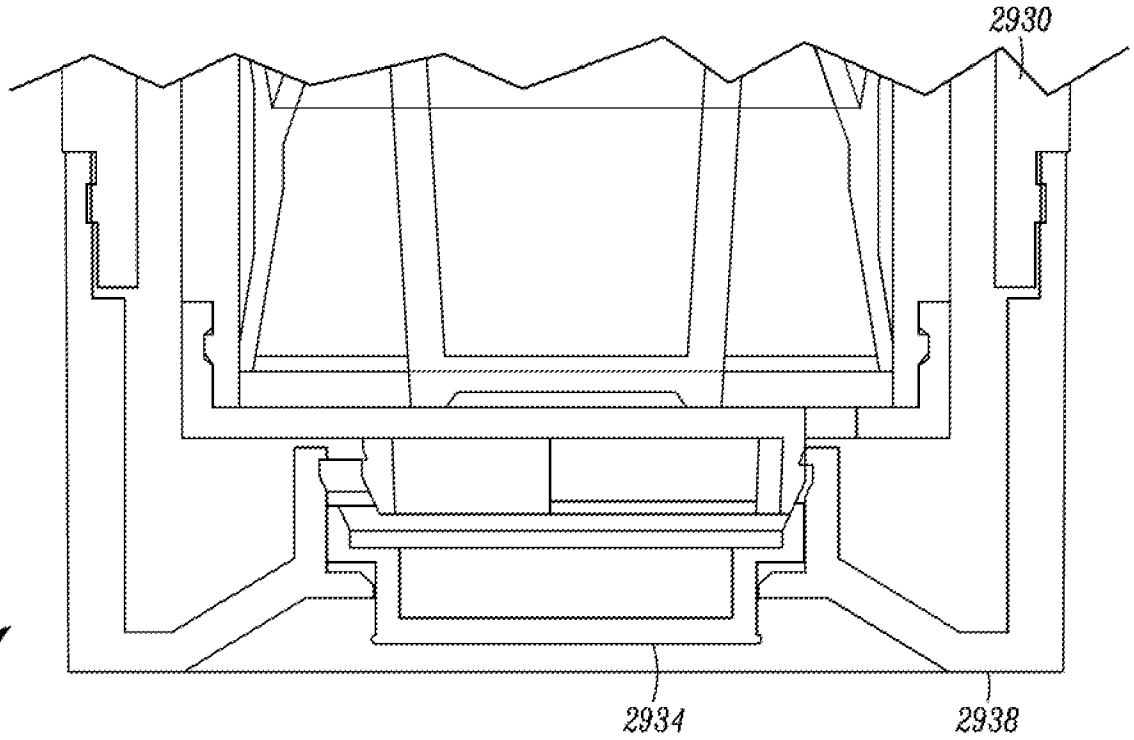
FIG. 47 is an enlargement of a portion of FIG. 45.

FIG. 47 is an enlargement of a portion of FIG. 45.

The reusable bottle package 100, 2900 is secured by snapping together the two halves of the pump which captures the inner collar. In the second embodiment of the reusable bottle package 2900, the snap feature is a cantilever snap joint. The actuator 2902 has a friction fit to a stem of the pump engine 2910 which also keeps the pump engine 2910 from separating from the actuator 2902 as the inner bottle 2918 is replaced by the consumer. The gasket 2914 is friction fit and has a slightly greater diameter than its minor thread dimension.

The pump engine 2910 is removable from the inner bottle 2918 via a threaded neck finish.

A consumer depresses the button to eject the entire inner assembly, as shown in FIG. 5. Once the entire inner assembly is ejected, the consumer unscrews the depleted inner bottle 2918 from the inner collar 2906 and screws a new inner bottle on the inner collar. The following are some of the steps for replacing an empty inner bottle with a new inner bottle:

1. Depress the pliable button until all of the at least one snap feature disengage.
2. Remove the entire inner assembly from the outer assembly.
3. Unscrew the inner bottle from the inner collar.
4. The gasket and pump do not fall to the floor because they are secured through other snap features and by a friction fit.
5. Dispose of the inner bottle.
6. Screw a new inner bottle onto the inner collar.
7. Put the entire inner assembly into the outer assembly, and move the entire inner assembly deeper into the outer assembly until all of the at least one the snap feature engage.

With the above method, the pump is re-used. The above method is applicable to the first embodiment which includes the pliable button 434 and to the second embodiment that includes the rigid button 2934.

Alternatively, the consumer ejects the entire inner assembly including the pump engine 2910 and depleted inner bottle 2918 and drops in a new inner assembly including a new pump engine and a new full inner bottle.

In some embodiments, the reusable bottle package is dip-tube style product. Such a dip-tube style product may dispose a lotion. A reusable bottle package 4800 in accordance with a third embodiment of the invention is shown in shown in FIGS. 48-53. The reusable bottle package 4800 includes an over cap 4803, a pump assembly that includes an actuator and a pump engine 4805, a pump collar 4807, an inner bottle 4809, an outer bottle 4811, and a push-to-release button (hereinafter "push button") 4813. The pump assembly includes an atmospheric pump. The pump collar 4807 cooperates with the outer bottle 4811 to form at least one snap feature. The reusable bottle package 4800 includes features making it reusable due to the removable and replaceable inner bottle 4809 via actuation of the push button 4813. The inner bottle 4809 is secured to the outer bottle 4811 by at least one snap feature near the top of the reusable bottle package 4800. The at least one snap feature comprises three snap beads 4820 located around the pump collar 4807.

Figure 48:
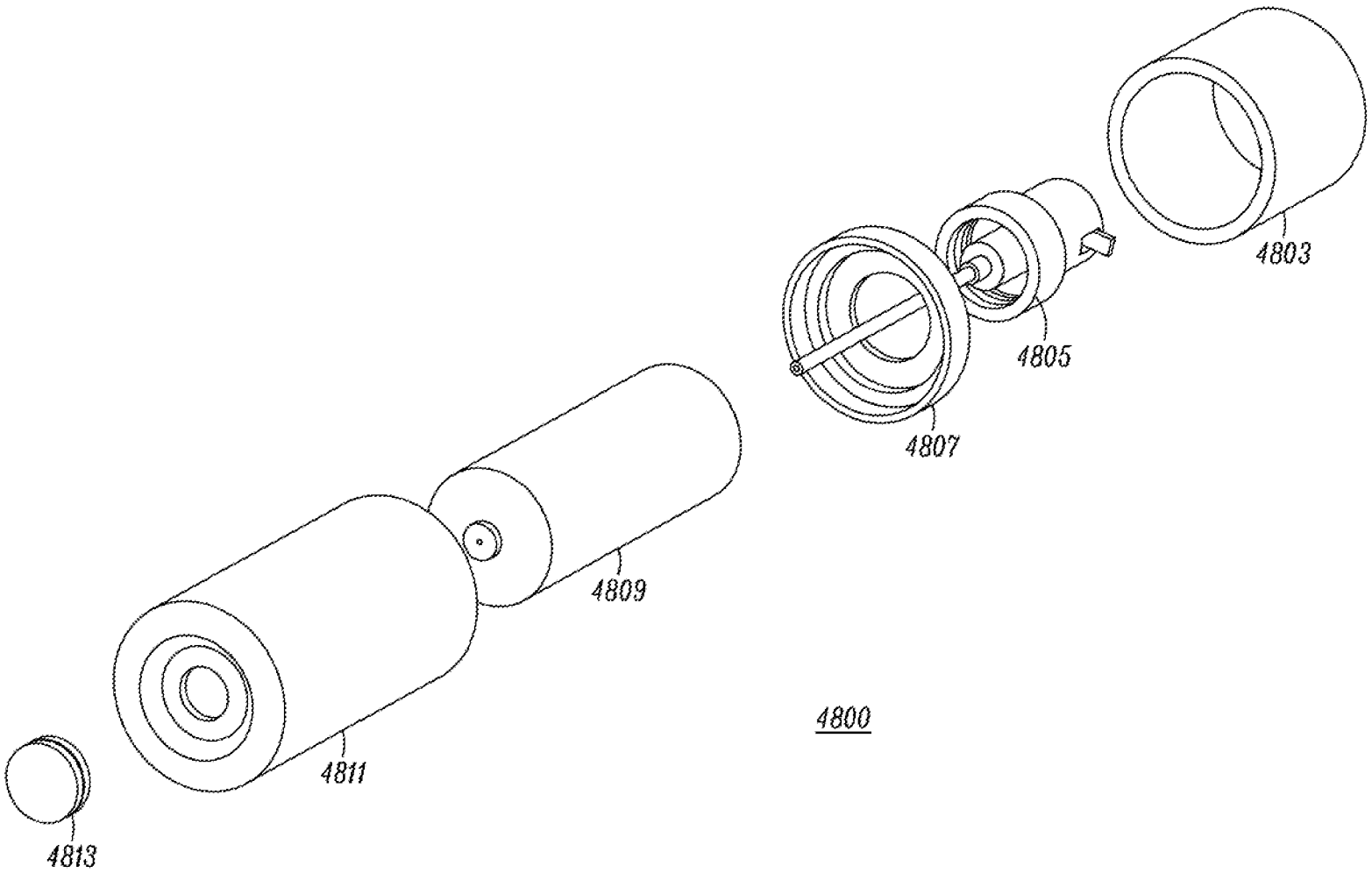
FIG. 48 is an exploded view of a reusable bottle package in accordance with a third embodiment of the invention, including a push-to-release button.

FIG. 48 is an exploded view of the reusable bottle package 4800.

Figure 49:
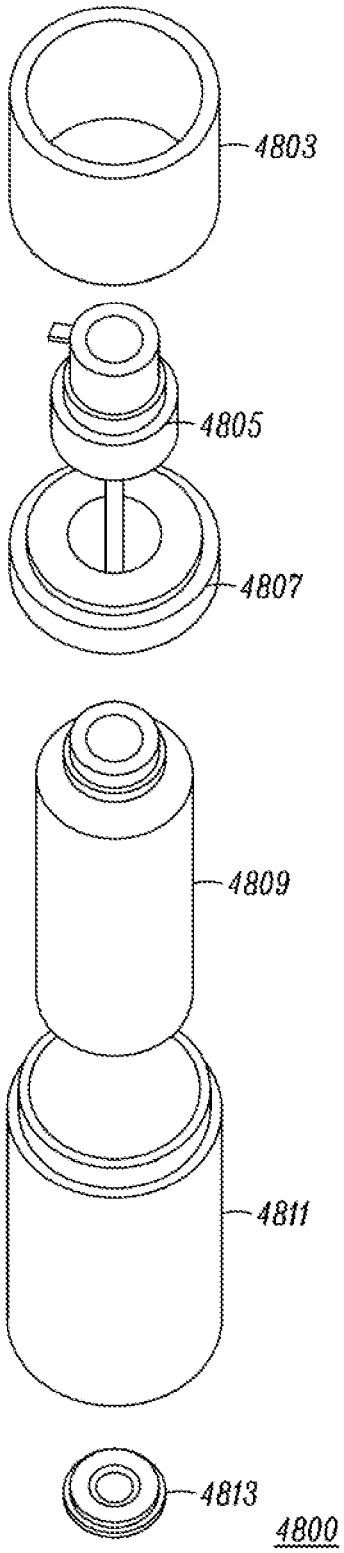
FIG. 49 is another exploded view of the reusable bottle package in accordance with the third embodiment of the invention, including the push-to-release button.

FIG. 49 is another exploded view of the reusable bottle package 4800.

Figure 50:
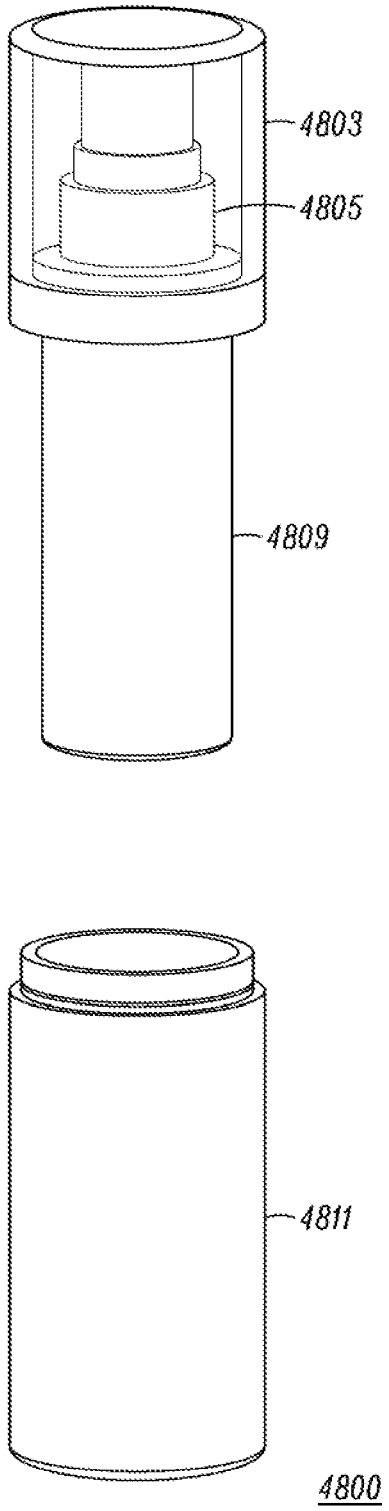
FIG. 50 is a perspective view of the third embodiment of the reusable bottle package.

FIG. 50 is a perspective view of the reusable bottle package 4800.

Figures 51, 52, 53:
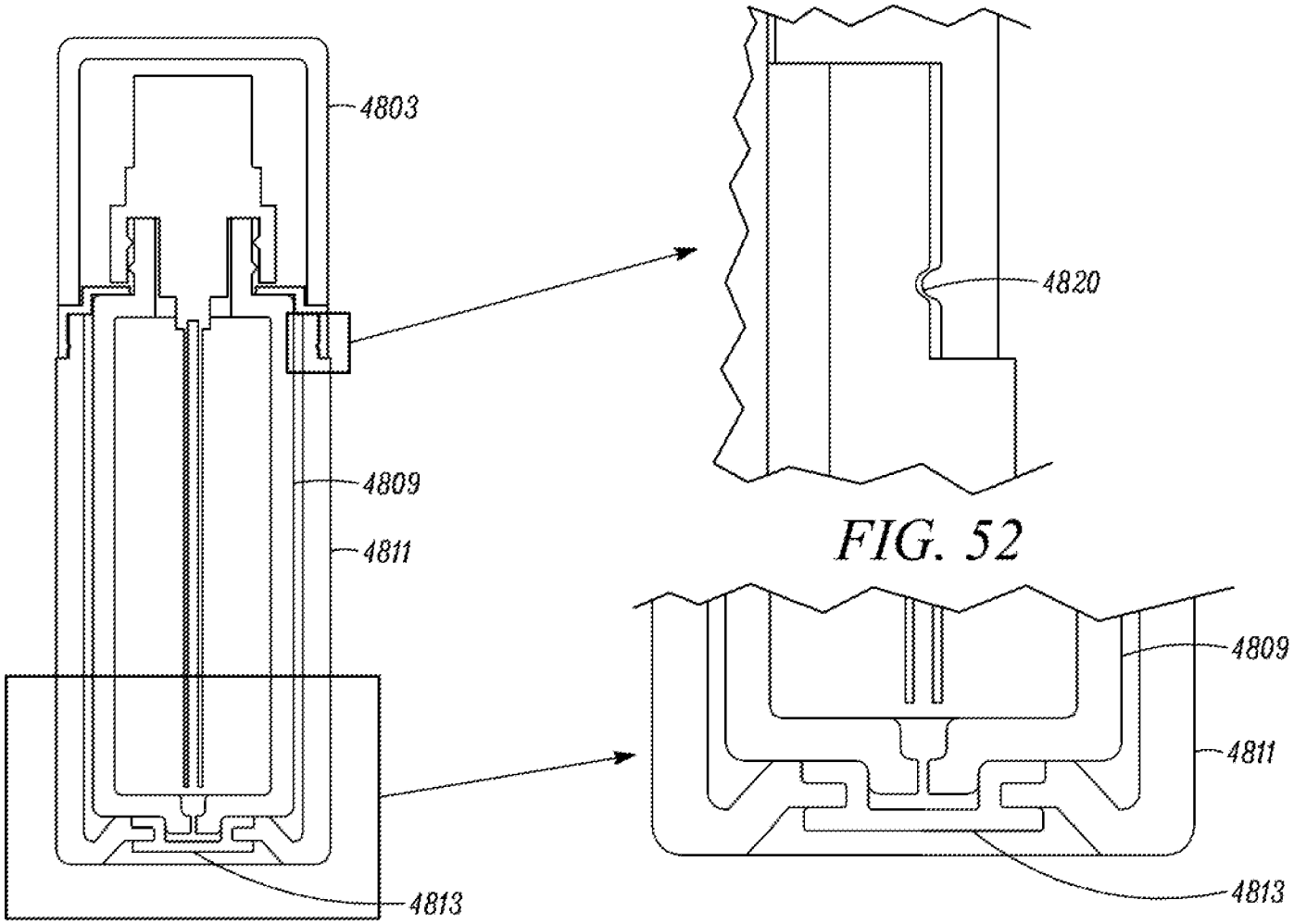
FIG. 51 is a cut-away side view of the third embodiment of the reusable bottle package.
FIG. 52 is an enlargement of a first region of FIG. 51.
FIG. 53 is an enlargement of a second region of FIG. 51.

FIG. 51 is a cut-away side view of the reusable bottle package 4800.

FIG. 52 is an enlargement of a first region of FIG. 51, showing details of one of the at least three snap beads.

FIG. 53 is an enlargement of a second region of FIG. 51.

The reusable bottle package 100, 2900, 4800 is geared towards a product in the cosmetic industry that dispenses a liquid or a liquid-like substance that has increased sustainability, user friendliness and superior functionality when compared to existing products.

The increase in sustainability of the reusable bottle package 100, 2900, 4800 can be attributed to the continuous reusability of the pump engine 410, 2910, 4805 and outer bottle 430, 2930, 4811 along with the incorporation of a disposable and replaceable inner bottle 418, 2918, 4809. The outer bottle 430, 2930, 4811, the outer base 438, 2938, the piston 422, 2922, the inner bottle 418, 2918, 4811 the inner collar 406, 2906, the inner base 426, 2926, and the actuator 402, 2902 of the reusable bottle package 100, 2900, 4800 is made from polypropylene with the recycle code of "5" which can be made at varying levels of post-consumer recycled polypropylene. A purpose of the reusable bottle package 100, 2900, 4800 is to increase sustainability of packages in the cosmetic industry. The material of the outer bottle 430, 2930, 4811 the outer base 438, 2938, the inner bottle 418, 2918, 4809 the inner collar 406, 2906, the inner base 426, 2926, and the actuator 402, 2902 may include less than 1% of a thermoplastic elastomer. The thermoplastic elastomer improves impact properties of polypropylene.

The user friendliness of the reusable bottle package 100, 2900, 4800 is attributed to the ease of removal of the inner bottle 418, 2918, 4809 via button actuation by an optimal release force. The amount of release force needed to disengage the snap feature is the range of 1 to 8 inch-pounds.

Snap features may vary in number of snap features, shape, size and location on the reusable bottle package 100, 2900, 4800.

The button 434, 2934, 4813 may vary in shape, size and location.

The terms "a" or "an", as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an". The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

The Detailed Description section, and not the Abstract section, is intended to be used to interpret the claims. The Abstract section may set forth one or more but not all embodiments of the invention, and the Abstract section is not intended to limit the invention or the claims in any way.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages or solutions to problems that are described herein with regard to specific embodiments are not intended to be construed as a critical, required, or essential feature or element of any or all the claims.

We claim:

1. A reusable bottle package, comprising:

an inner bottle, an inner base coupled to the inner bottle, an outer bottle, an outer base coupled to the outer bottle, and a push-to-release button contained by the outer base, wherein the outer base cooperates with the inner base to form at least one snap feature, wherein the inner bottle is secured within the outer bottle when the at least one snap feature is engaged, and wherein the at least one snap feature becomes disengaged when the push-to-release button is depressed, thereby allowing the inner bottle to be removed from within the outer bottle.

2. The reusable bottle package of claim 1, wherein the push-to-release button is pliable.

3. The reusable bottle package of claim 1, wherein the push-to-release button is rigid.

4. The reusable bottle package of claim 1, wherein the at least one snap feature includes an annular snap joint.

5. The reusable bottle package of claim 1, wherein the at least one snap feature includes a cantilever snap joint.

6. The reusable bottle package of claim 1, wherein the at least one snap feature becomes disengaged when the push-to-release button is depressed with a force of 1-8 inch-pounds.

7. A method with a reusable bottle package for replacing an inner assembly secured to an outer bottle by at least one snap feature when the at least one snap feature is engaged, comprising:

depressing a push-to-release button at a bottom of the outer bottle until the at least one snap feature disengages;

removing the inner bottle assembly the outer bottle, the inner assembly including an inner bottle attached to an inner collar;

unscrewing the inner bottle from the inner collar;

disposing of the inner bottle;

screwing a new inner bottle onto the inner collar; and moving a new inner assembly including the inner collar and the new inner bottle, into the outer bottle until the at least one the snap feature engages.

8. The method of claim 7, wherein an amount of force needed to be applied to the push-to-release button to disengage the at least one snap feature is 1 to 8 inch-pounds.

9. The method of claim 7, wherein the at least one snap feature includes an annular snap joint.

10. The method of claim 7, wherein the at least one snap feature includes a cantilever snap joint.

11. The method of claim 7, wherein the push-to-release button is made from one of: a thermoplastic elastomer material, a thermoplastic polyurethane material, a silicone material, a thermoplastic rubber material, a thermoplastic urethane material, and another thermoset material.

12. The method of claim 7, wherein the push-to-release button is made from one of: a polypropylene material, an acrylonitrile butadiene styrene material, a nylon material, a filled material, a plastic, a moldable polymer, a resin and a glass.

13. A dip-tube style reusable bottle package, comprising:

a pump collar;

a pump assembly coupled to the pump collar, the pump assembly including an actuator and an atmospheric pump;

an outer bottle coupled to the pump collar, wherein the pump collar and the outer bottle cooperate to form at least one snap feature;

an inner bottle located within the outer bottle, the inner bottle secured inside the outer bottle by the at least one snap feature when the at least one snap feature is engaged; and a push-to-release button for disengaging the at least one snap feature when the push-to-release button is depressed by a user, wherein the inner bottle is removable from inside the outer bottle after the at least one snap feature is disengaged.

14. The dip-tube style reusable bottle package of claim 13, wherein the at least one snap feature includes three snap beads located around an inside surface of the pump collar.

15. The dip-tube style reusable bottle package of claim 13, including another inner bottle for securing within the outer bottle by the at least one snap feature after the inner bottle is removed from inside the outer bottle.

16. The dip-tube style reusable bottle package of claim 13, wherein the push-to-release button is pliable.

17. The dip-tube style reusable bottle package of claim 13, wherein the push-to-release button is rigid.

18. The dip-tube style reusable bottle package of claim 13, wherein the push-to-release button disengages the at least one snap feature only after the push-to-release button is depressed with a force of 1-8 inch-pounds.

19. The dip-tube style reusable bottle package of claim 13, wherein the pump collar, the pump assembly, the outer bottle, and the inner bottle are made from polypropylene.

20. The dip-tube style reusable bottle package of claim 19, wherein the pump collar, the pump assembly, the outer bottle, and the inner bottle includes less than 1% of a thermoplastic elastomer.

* * * * *